United States Patent [19]

Dexter et al.

[11] 4,090,955

[45] May 23, 1978

[54] SELECTIVE FLOCCULATION OF MINERALS FROM A MIXTURE OR AN ORE

[75] Inventors: Robin William Dexter, Ilkley; Douglas Rusling, Bradford, both of England

[73] Assignee: American Cyanamid Company, Stamford, Conn.

[21] Appl. No.: 683,349

[22] Filed: May 5, 1976

[51] Int. Cl.[2] ..... B03B 1/04

[52] U.S. Cl. ..... 209/5

[58] Field of Search ..... 209/5; 210/54, 54 A, 210/54 B, 54 C

[56] References Cited

U.S. PATENT DOCUMENTS

| | | | |
|---|---|---|---|
| 3,138,550 | 6/1964 | Woolery | 209/5 |
| 3,347,832 | 10/1967 | Mills | 210/54 C X |
| 3,418,237 | 12/1968 | Booth | 209/5 X |
| 3,479,282 | 12/1973 | Chamot | 210/54 A |
| 3,776,892 | 12/1973 | Bleyle | 210/54 C X |
| 3,859,212 | 1/1975 | Smalley | 210/54 C X |
| 3,975,496 | 8/1976 | Smalley | 210/54 A X |

FOREIGN PATENT DOCUMENTS

| | | | |
|---|---|---|---|
| 589,543 | 12/1959 | Canada | 210/54 |
| 2,422,429 | 11/1974 | Germany | 210/54 |
| 13,483 | 6/1965 | Japan | 210/54 |
| 846,515 | 8/1960 | United Kingdom | 210/54 |

*Primary Examiner*—Robert Halper
*Attorney, Agent, or Firm*—William J. van Loo

[57] ABSTRACT

Modification of a polyacrylamide to provide a content of N-hydroxymethyl groups thereon results in a selective flocculant which is effective in separating mineral values from an ore or mixture.

5 Claims, No Drawings

SELECTIVE FLOCCULATION OF MINERALS FROM A MIXTURE OR AN ORE

This invention relates to the preparation and use of certain polymeric flocculants which selectively flocculate a specific range of valuable minerals from ore mixtures or dolomite- and silicate-containing ores. More particularly, it relates to the preparation of polyacrylamide modified to contain N-hydroxymethyl groups, which modification provides the polyacrylamide with the property of selectively flocculating malachite, chalcocite, and certain other materials, while it does not flocculate dolomite and silicate gangues.

The use of polymeric materials in mineral recovery processes is previously known. For example, in U.S. Pat. No. 2,740,522, issued Apr. 3, 1956 to Aimone et al., there is disclosed a process for concentrating ores containing gangue slimes which comprises subjecting an aqueous pulp of the ore to froth flotation in the presence of a collector and a gangue depressant. The gangue depressant is defined as a water-soluble salt of an anionic linear addition polymer of a polymerizable monoethylenically unsaturated compound having an average molecular weight of at least 10,000 and being present in an amount sufficient to depress substantially the gangue slimes. Thus, in this reference, action of the polymeric material is directed toward the slimes, not the desired mineral values.

In U.S. Pat. No. 2,923,408, issued Feb. 2, 1960 to Williams, there is disclosed a process for the preparation of sylvinite ore for the recovery of potassium chloride by flotation which comprises suspending ground sylvinite ore in brine saturated with respect to the ore to form a pulp, conditioning the pulp with a frother and with a water-soluble acrylamide polymer, subjecting the conditioned pulp to froth flotation, and separating clay therefrom as a flotated concentrate. The reference teaches that the polymer is an effective collector for clay, not mineral values, in the froth flotation process.

In U.S. Pat. No. 3,805,951, issued Apr. 23, 1974 to Brogoitti et al., there is disclosed a process for desliming a sylvinite ore comprising conditioning the ore, pulped in saturated brine, with an acrylamide polymer and then with a cationic collector for the slimes, subjecting the conditioned ore pulp to froth flotation, and removing the floated slimes. The reference teaches that the slimes are flocculated by the acrylamide polymer and then selectively floated by the cationic collector.

Thus, as is clear from the cited references, although polyacrylamide has previously been employed as a flocculant in mining processes, its utility has been that of a flocculant for gangue materials rather than for mineral values. As indicated by the cited references, polyacrylamide does not show any selective flocculating ability for mineral values. It would be desirable to use a flocculant to recover mineral values directly and thus avoid the necessity of having to employ flotation procedures. Since polyacrylamide does not exhibit selective flocculating ability for mineral values, it would be desirable to provide a polyacrylamide modified so as to exhibit selective flocculating ability for mineral values.

N-hydroxymethyl acrylamide is well-known and is used industrially as a cross-linking monomer in applications involving surface coatings. It is theoretically possible to homopolymerize N-hydroxymethyl acrylamide or to copolymerize it with acrylamide. However, efforts to effect such polymerizations lead to the formation of water-insoluble cross-linked polymers.

Polyacrylamides containing a substituted N-methylol grouping may be the result of the preparation of Mannich bases. Two procedures are commonly used in this preparation. In one, formaldehyde is pre-reacted with a secondary amine and the reaction product is then reacted with polyacrylamide. In the second, polyacrylamide, formaldehyde, and a secondary amine are reacted in alkaline medium. In this second preparation, alternative reactions can occur. The formaldehyde can react with the amine first and the resulting product can then react with the polyacrylamide. Alternatively, the formaldehyde can react with the polyacrylamide first and the resulting product can then react with the secondary amine. In this latter alternative, a polyacrylamide having an N-hydroxymethyl grouping would arise as an intermediate. However, since the reaction of formaldehyde with polyacrylamide and secondary amine is rapid, the predominant product obtained is the Mannich base, the product intended.

It is a primary object of the present invention to provide a polyacrylamide modified so that it exhibits selective flocculating ability for mineral values.

It is a further object of the present object to provide an N-hydroxymethyl polyacrylamide that exhibits selective flocculating ability for mineral values such as copper-bearing minerals while excluding dolomite, silica, or silica/quartz fractions of the ore.

It is, still further, an object of the present invention to provide an effective method of preparing an ungelled, water soluble N-hydroxymethyl polyacrylamide.

Additionally, it is an object of the present invention to provide a process for selectively flocculating desired mineral values from an aqueous suspension containing the desired mineral values and other materials.

In accordance with the present invention, there is provided a polyacrylamide flocculant selective for mineral values, said polyacrylamide containing linearly repeating structural units of:

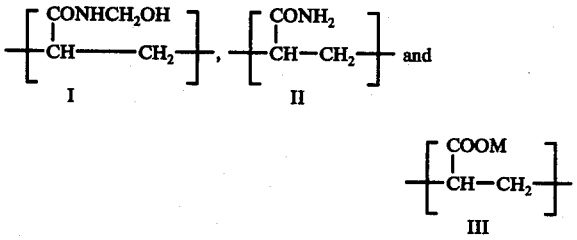

wherein the units designated I and II comprise from about 60 to 100 mole percent of the total mole content of said polyacrylamide; the units designated III comprise from 0 to about 40 mole percent of the total mole content of said polyacrylamide; the units designated I comprise from about 20 to 87 mole percent of the total moles of units I and II in said polyacrylamide; M represents methyl, hydrogen, ammonium or an alkali metal ion; and the total molar content of said polyacrylamide is such as to provide a polymer which as a 0.10 weight percent solution in 1M NaCl at 25° C. has a viscosity in the range of about 2.0 to 5.0 centipoises when the units designated I are present as units designated II.

In accordance with the present invention, there is also provided a process for preparation of the above-described modified polyacrylamide which comprises:

(1) preparing an aqueous solution containing from about 0.5 to 5 weight percent of a polyacrylamide containing from about 60 to 100 mole percent of acrylamide units and from about 0 to 40 mole percent of acrylate units, said acrylate units being in the form of free acrylic acid or the methyl ester, the ammonium salt or an alkali metal salt thereof and having as a 0.10 weight percent solution in 1M NaCl at 25° C. a viscosity in the range of about 2.0 to 5.0 centipoises; (2) adding to the solution sufficient formaldehyde to provide a mole ratio of formaldehyde to amide groups present in said polyacrylamide in the range of about 0.2:1 to 2:1, respectively; (3) adjusting the pH value of the solution to a value in the range of 9–12; and (4) reacting said formaldehyde with said amide groups to provide from about 20 to 87 mole percent of N-hydroxymethyl groups.

In accordance with the present invention, there is further provided a process for concentrating desired mineral values of an ore or an ore mixture which comprises: (1) preparing a dispersion of the ore at a particle size less than about 10 microns in water with the aid of a suitable dispersant; (2) flocculating the desired mineral values by adding to said dispersion an effective amount of the selective polyacrylamide flocculant described above; and (3) thereafter recovering the flocculated mineral values.

The present invention provides a polyacrylamide modified so as to exhibit selective flocculating ability for mineral values, a completely unexpected result in view of the prior art which teaches only polyacrylamides having flocculating ability for gangue materials rather than mineral values. This result is all the more surprising in view of the nature of the modification effecting the flocculating selectivity. The invention also provides the only known process by which the selective flocculant can be prepared. It is surprising that this preparative process should be effective while other procedures fail. Further, the present invention provides a process wherein desired mineral values can be selectively flocculated from dispersions of such mineral values in admixture with other ores or gangue materials. The process is effectively carried out with finely divided ores normally too small for use in flotation procedures and thus enables mineral values to be recovered from the slimes of other processes. This is a particular advantage of the present process in that it enables mineral values that normally would be discarded to be effectively recovered. The present process, by avoiding flotation or froth flotation procedures, is a much simpler process to perform.

The selective polyacrylamide flocculant of the present invention is a polyacrylamide modified to contain hydroxymethyl groups attached to the amide nitrogens thereof whereby the selective flocculating ability results. The polyacrylamide prior to modification as indicated may be a homopolymer of acrylamide or a copolymer of at least 60 mole percent acrylamide and up to about 40 mole percent of acrylic acid, the latter alternatively being present as the methyl ester, the ammonium salt, or an alkali metal salt. The degree of polymerization of the polyacrylamide prior to modification is such that a 0.10 weight percent solution thereof in 1 molar NaCl at 25° C. has a viscosity in the range of about 2.0 to 5.0 centipoises, preferably from about 3.5 to 5.0 centipoises. The content of N-hydroxymethyl groups in the modified polyacrylamide should be in the range of about 20 to 87 mole percent of the total amide content of the resulting modified polyacrylamide. Due to the conditions of reaction necessary to effect the necessary N-hydroxymethyl modification, some hydrolysis of the starting polyacrylamide may occur, thus increasing slightly the content of acrylic acid units, as defined. It is preferred that the N-hydroxymethyl content of the modified polymer be about 50 to 87 mole percent of the total amide content.

Modification of the initial polyacrylamide to provide N-hydroxymethyl groups therein will result in a product having a different solution viscosity from the unmodified polyacrylamide. This viscosity difference will vary depending upon the content of structural units making up the unmodified polyacrylamide and the extent to which N-hydroxymethyl groups are introduced into the modified polyacrylamide. Accordingly, there is no precise manner by which the solution viscosity of the modified polyacrylamide can be defined except in terms of the unmodified polyacrylamide, i.e. the corresponding polyacrylamide in which no N-hydroxymethyl groups are present or in which the groups designated I above are in the form of groups designated II above. As indicated, the unmodified polyacrylamide should have as a 0.10 weight percent solution in 1M NaCl at 25° C. a viscosity in the range of about 2.0 to 5.0 centipoises, preferably 3.5 to 5.0 centipoises. Since the modified polyacrylamides of the present invention are selective flocculants, they are water-soluble at useful concentrations.

The selective polyacrylamide flocculant of the present invention is prepared by reacting the corresponding polyacrylamide with sufficient formaldehyde to provide the necessary extent of N-hydroxymethyl substitution. The reaction is carried out by preparing an aqueous solution of about 0.5 to 5.0, preferably 1.0–2.0, weight percent of a suitable unmodified polyacrylamide, as defined. To the solution is added sufficient formaldehyde, preferably as formalin, to provide a mole ratio of formaldehyde: amide groups in the polymer in the range of about 0.2:1 to 2:1, preferably 2:1, and the solution pH is adjusted to a value in the range of 9–12, preferably 10.5–11.0. The resulting solution is reacted under agitation for up to 24 hours, preferably 2 hours, at a temperature in the range of about 20° to 100° C., preferably 60° C., until the desired degree of substitution is obtained. The degree of substitution effected can be calculated from the content of unreacted formaldehyde determined in the reaction product and reaction can be confirmed by infra-red spectrography. Reaction should be continued until from about 20 to 87 mole percent of hydroxymethyl groups, preferably 50 to 87 mole percent, based on the mole percent of amide groups in the unmodified polyacrylamide, have been introduced. The pH value of the reaction solution falls during the course of the reaction. Preferably the reaction solution is buffered with a buffer such as trisodium phosphate to provide higher conversion of amide groups to N-hydroxymethyl amide groups. Increased reaction temperature provides a more rapid approach to the maximum level of N-hydroxymethyl substitution attainable, which is about 87 mole percent of the amide groups percent in the polyacrylamide, but extended times at higher temperatures can cause gelation of the solution due to cross-linking of the polymer chains.

The ratio of the moles of added formaldehyde to the number of amide groups available for reaction determines to a great extent the number of amide groups which will react. Molar ratios of formaldehyde: amide groups of from about 0.2:1 to 2:1 will provide the specified range of reacted amide groups. Complete reaction of all of the amide groups does not appear possible since the number of amide groups reacted does not increase in direct proportion to the mole ratio of formaldehyde added.

Polyacrylamide forms viscous solutions when dissolved in water, the viscosity increasing with molecular weight. As a result, there is a practical limit as to the solution strength of a polyacrylamide that can effectively be employed. In preparing the modified polyacrylamides of the present invention, the maximum solution strength that can be handled should be used in the reaction with formaldehyde. The relationship between solution viscosity and usable solution strength generally is given by the following table.

| Brookfield Standard Viscosity, centipoises[1] | Usable Solution Strength (% by weight) |
|---|---|
| 4.0 | 1 |
| 3.5 | 2 |
| 3.0 | 3 |
| 2.5 | 5 |

[1]-Ultra Low Viscosity Adaptor - 0.10% solution in 1 molar NaCl at 25° C.

Hence, in the preferred molecular weight range, i.e. greater than 3.5 centipoises viscosity at the specified conditions, a maximum solution strength of 2% by weight may be used. Lower molecular weight polymers, i.e. viscosity 2.5 or less, same basis, may be used at about 5% solution strength by weight. A higher extent of amide modification is obtained at higher polyacrylamide solution strength. During the reaction of the polyacrylamide with formaldehyde, an increase in viscosity of the solution occurs due to the change in size of the polymer side-chains.

Pre-formed copolymers of acrylamide react with formaldehyde in solution to give N-methylol substituted products. These polymers are of higher viscosity than unmodified homopolymers of acrylamide and differ in flocculation properties.

In carrying out selective flocculation in accordance with the present invention, the selected ore is prepared as a suspension in water of particle size less than about 10 microns be use of a suitable dispersant. The selected ore may be crushed to provide particles which can be subsequently ground to a size less than about 10 microns. The crushed ore may be dispersed in water with a suitable dispersant and conditioned to a particle size of less than about 10 microns. After the desired suspension is obtained, an effective amount of selective flocculant is added with agitation so as to be uniformly distributed throughout the suspension. Agitation is then stopped and the flocs formed are allowed to settle. After settling is accomplished, the sediment is recovered, conveniently by decanting the supernatant, to provide concentrated mineral values.

Suitable dispersants include solium silicate, sodium hexameta phosphate, trisodium phosphate, and sodium polyacrylate, which are used to prevent heterocoagulation of the suspension. Generally 50–500 parts per million (ppm) of dispersant are required. The selective flocculant generally provides effective flocculation at about 0.5 to 10 ppm and best results are generally obtained in the range of about 1–2 ppm.

The selective flocculants of the present invention are effectively employed in recovering malachite from silica and dolomite, chalcocite from silica and dolomite, copper values from Zaire (Tenku Fungarumi) and Zambia (Chingola) ores, and desired mineral values from other ores or mixtures.

The invention is more fully illustrated by the examples which follow wherein all parts and percentages are by weight unless otherwise specified.

EXAMPLES 1–4

A series of preparations of N-hydroxymethyl substituted polyacrylamides was prepared using a homopolymer of acrylamide in the form of an aqueous solution of 0.93% polymer having as a 0.10% solution in 1M NaCl at 25° C. a viscosity of 3.9 centipoises. Aliquots of the solution were adjusted to the pH values given in Table I below. To each aliquot was then added 0.71 mole of formaldehyde per mole of amide in the polymer present and the pH was readjusted to the initial value. The aliquots were reacted at 20° C. for 70 hours. Results are given in Table I.

TABLE I

| Ex. | Initial pH Value | Amide Groups Reacted (%) | Hydrolysis(%) Estimated |
|---|---|---|---|
| 1 | 9.3 | 11.2 | 0.1 |
| 2 | 9.9 | 26.0 | 0.2 |
| 3 | 10.7 | 44.5 | 0.4 |
| 4 | 11.1 | 56.0 | 0.4 |

EXAMPLES 5 AND 6

The polyacrylamide solution described above was employed for two additional preparations using a HCHO: amide ratio of 1:1 and an initial pH value of 11.5. One example, Example 5 was reacted unbuffered and the other, Example 6, was buffered with trisodium phosphate. The extent of amide group reaction was 46.0% for unbuffered Example 5 and 47.5% for buffered Example 6.

EXAMPLES 7–12

The polymer solution of Example 1 was again employed. The solution was adjusted to a pH value of 10.65. Formaldehyde equivalent to 1 mole per mole of amide groups in the polymer was added and the pH was again adjusted to 10.65. The reaction solution was divided into six aliquots, which were then reacted at the temperatures and for the time intervals indicated in Table II.

TABLE II

| Ex. | Reaction Time | Amide Groups Reacted(%) at Reaction Temperature 20° C. | 60° C. |
|---|---|---|---|
| 7 | 1 hr. 30 min. | 15.0 | — |
| 8 | 1 hr. 30 min. | — | 27.5 |
| 9 | 3 hrs. 45 min. | 27.5 | — |
| 10 | 3 hrs. 45 min. | — | 45.0 |
| 11 | 21 hrs. 30 min. | 51.5 | — |
| 12 | 21 hrs. 30 min. | — | 52.5[1] |

[1]Insolubles formed, crosslinking evident.

EXAMPLES 13–17

The polymer of Example 1 was again repeated except that the initial solution contained 1% polymer. The initial solution pH was 11.0. Five aliquots were taken and the ratio of formaldehyde to amide groups present was varied as shown in Table III below. The pH was adjusted to the initial value after addition of the formaldehyde and the resulting solutions were reacted at 60° C. for 1.5 hours. Results are given in Table III.

TABLE III

| Ex. | HCHO/Amide Ratio | Amide Groups Reacted (%) |
|---|---|---|
| 13 | 0.2:1 | 19.6 |
| 14 | 0.4:1 | 32.6 |
| 15 | 0.6:1 | 40.1 |
| 16 | 1.0:1 | 59.5 |
| 17 | 2.0:1 | 86.5 |

EXAMPLES 18–21

A homopolymer of acrylamide having as a 0.10% solution in 1M NaCl at 25° C. a viscosity of 2.5 centipoises was employed. Separate solutions at four different polymer concentrations as shown in Table IV were prepared. Each solution was adjusted to pH 10.5. A ratio of HCHO/Amide groups of 1:1 was employed in each solution and the pH was readjusted to 10.5 after formaldehyde addition. Reaction in each instance was at 60° C. for 1.5 hours. Results are given in Table IV.

TABLE IV

| Ex. | Solution Strength(%) | Amide Groups Reacted (%) |
|---|---|---|
| 18 | 0.10 | 8–10 |
| 19 | 0.50 | 21 |
| 20 | 1.00 | 30 |
| 21 | 4.10 | 79 |

EXAMPLES 22–26

A series of polyacrylamides of different compositions were evaluated, each polymer having a viscosity at 0.10% in 1M NaCl at 25° C. of approximately 3.9 centipoises. Separate solutions were prepared of the polymers at 1%, the solutions were adjusted to pH 11.0, the HCHO/amide group ratio employed was 2/1, the pH values were readjusted to the initial value after HCHO addition, and reaction in each instance was at 60° C. for 1.5 hours. Results are given in Table V.

TABLE V

| | Polymer Composition | | |
|---|---|---|---|
| Ex. | Acrylamide (%) | Sodium Acrylate (%) | Amide Groups Reacted (%) |
| 22 | 100 | 0 | 86.5 |
| 23 | 97.5 | 2.5 | 75.0 |
| 24 | 95 | 5 | 66.0 |
| 25 | 90 | 10 | 69.0 |
| 26 | 80 | 20 | 81.0 |

When the above examples were repeated using equivalent amounts of methyl acrylate in place of sodium acrylate, substantially the same results were obtained.

EXAMPLES 27–31

A. Polymer Preparation

(27) (Comparative Example) 2.00 grams of polyacrylamide (dry weight) of standard viscosity (0.10% in 1M NaCl at 25° C.) of 3.9 centipoises was dissolved in 200 grams distilled water. 0.473 grams of formalin (35.4% HCHO) was then added and the pH was then adjusted to 11.0. The solution was agitated at 60° C. for 1.5 hours. HCHO/Amide group ratio was 0.2:1.0.

(28) Followed the procedure of Example 27 except that 0.946 grams formalin added. HCHO/Amide group ratio was 0.4:1.0.

(29) Again followed the procedure of Example 27 except that 1.419 grams formalin added. HCHO/Amide group ratio was 0.6:1.0.

(30) Again followed the procedure of Example 27 except that 2.37 grams formalin added. HCHO/Amide group ratio was 1:1.

(31) Again followed the procedure of Example 27 except that 4.73 grams formalin added. HCHO/Amide group ratio was 2:1.

B. Selective Flocculant Evaluation

In 50 grams of distilled water were dispersed 0.5 gram 350 mesh malachite and 4.5 grams 350 mesh dolomite to give a suspension. 400 ppm (based on the total weight of the suspension) of sodium hexametaphosphate and 100 ppm (same basis) of sodium polyacrylate were added to disperse the particles completely. After 2 minutes conditioning by stirring, 0.5 milliliters of a 0.10% polymer solution was added (10 ppm, same basis) while stirring at moderate speed. After 1 minute the stirring speed was reduced and held for 10 minutes. The stirrer was then stopped and the flocs were allowed to settle. After 2 minutes settling, the supernatant was decanted off. Both supernatant and sediment were dried, weighed and analyzed for copper content. Results are given in Table VI.

TABLE VI

| | | Selective Flocculation | |
|---|---|---|---|
| Polymer of Example | Amide Groups Reacted (%) | Sediment Grade (%Cu) | Copper Recovered (%) |
| — | No Flocculant | 6.3 | 5.2 |
| — | Unmodified | 4.59 | 77 |
| 27 | 19.6 | 4.46 | 65 |
| (comparative) | 19.6 | | |
| 28 | 32.6 | 5.82 | 79 |
| 29 | 40.1 | 9.53 | 91 |
| 30 | 59.5 | 17.2 | 92 |
| 31 | 86.5 | 21.8 | 92 |

EXAMPLES 32–35

A. Polymer Preparation

The procedure of Example 30, A was followed except the polyacrylamides employed in separate examples varied as to their standard viscosities. Variations are shown in Table VII.

B. Selective Flocculant Evaluation

The procedure of Example 30, B was employed. Results are shown in Table VII.

TABLE VII

| Polymer of Example | Polyacrylamide Standard Viscosity (cps.) | Amide Groups Reacted (%) | Sediment Grade (%Cu) | Copper Recovery (%) |
|---|---|---|---|---|
| 32 | 3.9 | 59.5 | 17.2 | 92.0 |
| 33 | 2.9 | 59.3 | 19.0 | 23.5 |
| 34 | 2.6 | 57.0 | 11.3 | 11.9 |
| 35 | 2.1 | 61.0 | 10.7 | 10.8 |

EXAMPLES 36–38

A. Polymer Preparation

Three polyacrylamides of different composition but substantially equal standard viscosity were modified by reaction with formaldehyde. The three polymers were as follows:

(36) Polyacrylamide 100%, standard viscosity 3.9 cps.

(37) Copolymer of acrylamide 97.5 mole %, sodium acrylate mole 2.5%.

(38) Copolymer of acrylamide mole 95%, sodium acrylate mole 5%. Each polymer as a 1% solution was treated with formaldehyde at a 2:1 HCHO:Amide Group ratio as in Example 27.

B. Selective Flocculant Evaluation

A sample of Zaire (Tenku Fungarumi) ore, 2.50 grams, crushed to −30 mesh (500 microns) was ground with 2.5 ml. of a 1% solution of sodium polyacrylate for 5 minutes to reduce the size of the particles to −20 microns. A 5% suspension was prepared by diluting the ground sample to 50 mls. with distilled water.

2 mls. of 0.01% polymer solution was then added to the stirred suspension. Stirring continued for 10 minutes when the flocs were allowed to settle for 2 minutes. The supernatant was drawn off and the supernatant and sediment were dried, weighed and analyzed. Results are given in Table VIII.

TABLE VIII

| Polymer of Example | Composition[1] AM[2] | SA[3] | Amide Groups Reacted (%) | Sediment Grade (% Cu) | Copper Recovery (%) | Acid Consumption[4] Concentrate | Ore |
|---|---|---|---|---|---|---|---|
| 36 | 100 | 0 | 86.5 | 4.46 | 98.6 | 12.7 | 16.7 |
| 37 | 97.5 | 2.5 | 85 | 7.76 | 62.4 | 4.9 | 17.2 |
| 38 | 95 | 5 | 85 | 8.41 | 38.7 | 3.4 | 17.7 |
| No Polymer | | | — | 5.14 | 11.3 | — | 17.0 |

Notes:
[1]Mole percent
[2]AM = Acrylamide
[3]SA = Sodium Acrylate
[4]Milliliters of IN acid for sample taken.

Repeating the above examples but 500 ppm sodium silicate in one series and 500 ppm sodium hexametaphosphate in another series provided similar enrichment and recovery with similar reductions in acid usage.

We claim:

1. A process for selectively flocculating copper values while excluding dolomite, silica, or silica/quartz from an ore containing same which comprises: (1) preparing a dispersion of the ore at a particle size less than about 10 microns in water with an aid of a suitable dispersant; (2) flocculating the desired copper values by adding to said dispersion an effective amount of a selective polyacrylamide flocculant containing linearly repeating structural units of:

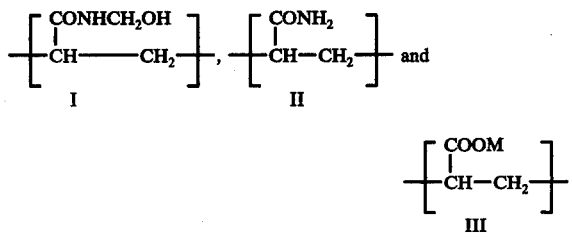

wherein the units designated I and II comprise from about 50 to 100 mol percent of the total mol content of said polyacrylamide; the units designated III comprise from 0 to about 40 mol percent of the total mol content of said polyacrylamide; the units designated I comprise from about 20 to 87 mol percent of the total mols of units I and II in said polyacrylamide; M represents methyl, hydrogen, ammonium or an alkali metal ion; and the total molar content of said polyacrylamide is such as to provide a polymer which has a 0.10 weight percent solution in 1M NaCl at 25° C. as a viscosity in the range of about 2.0 to 5.0 centipoises when the units designated I are present as units designated II; and (3) thereafter recovering the flocculated copper values.

2. The process of claim 1 wherein said mineral values are copper values.

3. The process of claim 1 wherein said dispersant is selected from trisodium phosphate, sodium silicate, sodium hexametaphosphate and sodium polyacrylate.

4. The process of claim 1 wherein said dispersant is used at 50–500 parts per million based on the dispersion being concentrated.

5. The process of claim 1 wherein said flocculant is used at 0.5 to 10 parts per million based on the dispersion being concentrated.

* * * * *

UNITED STATES PATENT OFFICE

CERTIFICATE OF CORRECTION

Patent No. 4,090,955 Dated May 23, 1978

Inventor(s) ROBIN WILLIAM DEXTER and DOUGLAS RUSLING

It is certified that error appears in the above-identified patent and that said Letters Patent are hereby corrected as shown below:

Column 10, line 13, after about, insert --60 -- instead of "50".

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*